United States Patent [19]

Müller

[11] Patent Number: 4,601,041

[45] Date of Patent: Jul. 15, 1986

[54] ELECTRODE MOUNTING IN DC ARC FURNACE VESSELS

[75] Inventor: Norbert Müller, Duisburg, Fed. Rep. of Germany

[73] Assignee: Mannesmann Aktiengesellschaft, Duesseldorf, Fed. Rep. of Germany

[21] Appl. No.: 607,381

[22] Filed: May 4, 1984

[51] Int. Cl.[4] ..... H05B 7/00

[52] U.S. Cl. ..... 373/72; 373/108

[58] Field of Search ..... 373/71, 72, 75, 76, 373/94, 98, 101, 107, 108; 266/236

[56] References Cited

U.S. PATENT DOCUMENTS

| | | | |
|---|---|---|---|
| Re. 16,054 | 4/1925 | Moore | 373/98 |
| Re. 17,954 | 2/1931 | Mills | 373/72 |
| 1,070,568 | 8/1913 | Wile | 373/72 |
| 1,363,815 | 12/1920 | Saklatwalla | 373/101 |
| 1,674,982 | 6/1928 | Moore | 373/72 |
| 2,594,972 | 4/1952 | Muehlenkamp | 373/36 |
| 4,121,042 | 10/1978 | Prenn | 373/93 |
| 4,228,314 | 10/1980 | Stenkvist | 373/72 |
| 4,277,638 | 7/1981 | Stenkvist | 373/72 |
| 4,324,943 | 4/1982 | Stenkvist et al. | 373/108 |
| 4,424,958 | 1/1984 | Bachmann | 266/236 |

*Primary Examiner*—A. D. Pellinen
*Assistant Examiner*—Gregory D. Thompson
*Attorney, Agent, or Firm*—Ralf H. Siegemund

[57] ABSTRACT

The electrode pins for an arc furnace are individually and separately mounted in the bottom of the furnace vessel in that the refractory lining of the vessel is provided with apertures receiving individual refractory perforated bricks traversed individually by an electrode pin, the electrode pin is secured in an insulated fashion to the metal jacket of the vessel and traverses the perforations of the bricks, moreover the pin is connected through appropriate clamping facilities to the cooled anode current feed mounted insulatedly underneath the bottom of the vessel.

8 Claims, 1 Drawing Figure

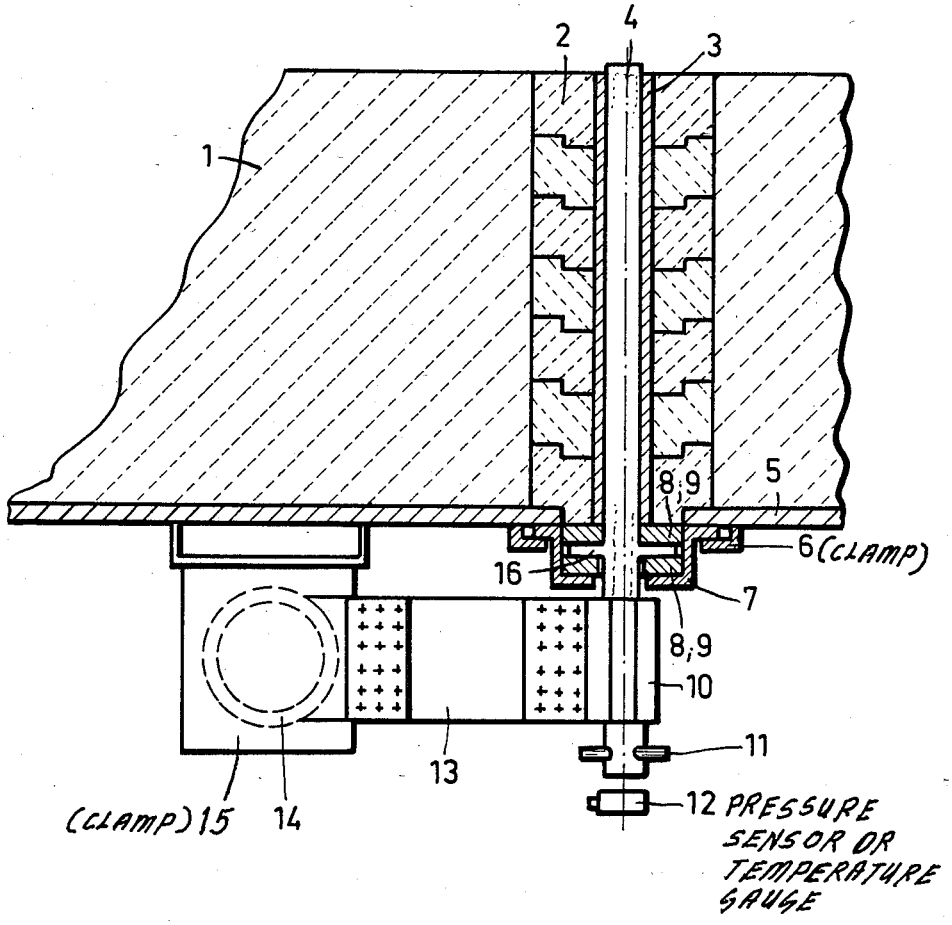
1
2
3
4
5
6 (CLAMP)
7
8,9
8,9
10
11
12 PRESSURE SENSOR OR TEMPERATURE GAUGE
13
14
(CLAMP) 15
16

ELECTRODE MOUNTING IN DC ARC FURNACE VESSELS

BACKGROUND OF THE INVENTION

The present invention relates to a furnace vessel for a dc arc furnace having particularly in a central portion of the bottom a contact device for the anode current which contact device is comprised of a plurality of electrode pins arranged in parallel to the axis of the vessel and being held in a refractory fireproof material. Moreover, a current path exists underneath the vessel which includes facilities for cooling.

The German printed patent application No. 2,958,090 suggests basically a device of the type outlined above, and includes particularly bottom contacts with a plurality of metal pins being secured with the upper end to a metal plate. German printed patent application No. 2,905,553 discloses, in addition, contact electrodes and arrangements for such electrodes, wherein contact pins are secured to a base plate underneath the bottom of the furnace. This base plate is connected with the underside of the furnace vessel bottom by means of vertically oriented walls. The intermediate space is passed through by a coolant flow.

The known arrangements for electrodes in the bottom of a furnace vessel does not permit exchange of the individual pins without extensive disassembly of the furnace. This is a disadvantage because the various electrode pins do not wear uniformly. Moreover, in the case of an exchange of the entire electrode bundle, it is necessary to supplement the fireproof refractory lining in the entire furnace vessel bottom.

DESCRIPTION OF THE INVENTION

It is an object of the present invention to provide a new and improved furnace vessel, and particularly an electrode mounting facility for bottom electrode pins constructed in such a manner that the pins can be individually exchanged without overall assembly and disassembly of the furnace vessel and without required renewal of the lining in the bottom portion of the vessel.

It is therefore a specific object of the present invention to provide a new and improved bottom construction for dc arc furnace vessels wherein a plurality of electrode pins, made of metal, are arranged in axis parallel relationship and are held on a fireproof lining material of the furnace vessel, and which further includes a current feed portion which is cooled and arranged under the bottom of the furnace.

In accordance with the preferred embodiment of the present invention, it is suggested to provide a holding structure for each bottom electrode pin in an arrangement as per the specific object in order to releasably fasten these pins in the vessel, whereby each electrode pin is individually electrically insulated vis-a-vis the furnace vessel, and can be inserted and removed in a plug-type action through fireproof, perforated or sleeve-like bricks. Moreover, these electrodes are individually connected to the cooled current feed portion. The holding devices are preferably arranged individually on the outside of the vessel bottom, and are preferably provided as fastening claws welded to the bottom and holding a sleeve or bushing, whereby a collar of the respective electrode pin is insulatedly fastened within the space enclosed by the holding bushing or clamping rings.

The individual electrode pins are connected to the cooling circulation of the feed system which is preferably arranged annularly around the axis of the vessel. The circulation of the coolant is preferably provided as a circulation of an inert gas. A pressure gauge is preferably connected to one of the pins. In accordance with other features of the invention, the pins are preferably connected to the respective current feed structure by means of a contact clamp having a metallic tension ribbon. The current feed structure in turn is connected in an insulated fashion to the bottom of the furnace vessel.

It can thus be seen that the construction in accordance with the preferred embodiment of the present invention permits exchange of the individual bottom electrode pins, depending upon the degree of wear. Since each bottom electrode pin is inserted in a perforated brick, which bricks in turn are integrated in the furnace lining, it is no longer necessary to exchange the entire refractory lining in the bottom portion of the vessel just because one or the other pin has to be exchanged. As compared with the vessels in accordance with the German printed patent application No. 2,958,090 mentioned above, an exchange of electrode pins from below is quite feasible.

The wear of the individual pins can be monitored through separate temperature or pressure controls. As mentioned above, the individual pins may be provided with temperature feelers or with a gas pressure gauge in case of gas cooling. Through pressure measurement one ascertains a pressure drop whenever the particular electrode pin has in effect melted away. In the case of bundled contact pins, a local control of the wear of individual pins as per the prior art is not possible. In a secondary fashion, one may provide sensors at the outer end of the pins for purposes of control of the wear of the furnace lining. Temperature measuring sensors or transducers are affixed to the individual bottom electrode pins and may then be used to signal local excess temperature values in the bottom portion of the vessel. In view of the fact that the individual bottom electrode pins are electrically insulated vis-a-vis the vessel itself, and additional insulation is no longer necessary.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

The FIGURE is a cross-section through a portion of a furnace vessel improved in accordance with the preferred embodiment of the present invention for practicing the best mode thereof.

Proceeding now to the detailed description of the figure, one can see a vessel, a portion only is illustrated, and here particularly the refractory lining 1 is particularly identified. This lining is provided for the bottom portion of the vessel, the metal container portion of the vessel is identified by reference numeral 5.

The FIGURE illustrates in particular an individual bottom electrode pin 4. This pin is generally arranged in the bottom 5 of the vessel, and is arranged particularly for easy insertion and removal. Only one of such pin is shown, but it is understood that there are as many such electrode pins as necessary. The number of pins is not part of the invention, only their particular mode of mounting.

It is essential that each of these pins is electrically insulated vis-a-vis the vessel, and here particularly the vessel bottom 5. The particular mounting of the pin 4 includes a plurality of perforated bricks 2 arranged in a larger opening within the refractory lining 1 and the bottom 5. These bricks 2 are of a configuration permitting an interengagement or interlinking, and they have each a central opening, the openings are aligned accordingly. The column of bricks 2 is supported at the bottom by a ceramic disk 8. The space between the individual bricks 2 and the particular electrode pin 4 is filled with a suitable refractory casting material 3.

The pins 4 are connected to an anode current feed structure 14, by means of a contact piece or clamp 10 made of steel and being plated by means of an explosion plating process with copper connecting vanes. A flexible element 13 is constructed as a tension band or ribbon 13 made of metal for connecting the contact clamp 10 to the anode current feed structure 14.

The current feed structure 14 is comprised of a copper tube and is arranged in an annular configuration underneath the bottom 5 of the vessel. The tube 14 is connected through an insulation clamp 15 to the bottom 5. In other words, the anode and current feed structure 14 is electrically insulated from the vessel 5.

A holding structure is provided on the outside of the furnace bottom 5, which holding structure fastens the particular bottom electrode pin 4. This fastening structure includes a fastening claw or clamp 6 which is welded to the bottom 5 of the vessel. A holding sleeve 7 is shifted into the clamp 6. The sleeve 7 has an upper, outwardly oriented flange to be received by clamp 6, while a lower, inwardly turned flange serves as a seat for a ceramic dish 9. There is a space established between the clamp 6 and the sleeve 7.

The electrode pin 4 is provided with a collar 16 which occupies that space and is held particularly between the two ceramic dishes 8 and 9, and thereby holds the pin vis-a-vis the welded unfastening structure. This collar 16 is electrically insulated through the ceramic insulation rings 8 and 9 vis-a-vis the holding parts 6 and 7 which are made of metal and have the same potential as the bottom 5 of the vessel.

An inert gas flows through the tube 14 which cools all parts in contact therewith. This particular gas is fed through connecting parts 11 also into the individual pins. Reference numeral 12 refers either to a temperature sensor or a pressure gauge arranged in the bottom porton of the pin 4. The pins are arranged in groups and they are arranged particularly around the elongated axis of the cathode electrode within the vessel. That cathode electrode or electrodes are not shown in the drawing.

The invention is not limited to the embodiments described above, but all changes and modifications thereof not constituting departures from the spirit and scope of the invention are intended to be included.

I claim:

1. In a vessel for a dc arc furnace having a bottom with a refractory lining, there being a cooled electric current feeding structure arranged outside of the vessel underneath the bottom, and further including a plurality of electrode pins, the improvement comprising a separate mounting facility for each pin, including in each instance:

a bore in said lining;

an electrode pin in said bore having a collar;

fastening means disposed outside of the vessel bottom and secured thereto, said fastening means includes a sleeve releasably receiving said pin and holding said pin through its collar thereby mounting said pin to said bottom of said vessel;

means electrically insulating said pin from said vessel bottom;

a plurality of fireproof, perforated bricks in said bore of said lining receiving said pin; and means connecting electrically said pin to said cooled current feeding structure.

2. The improvement as in claim 1 wherein said fastening means includes a fastening claw welded to said bottom, said holding sleeve is inserted into said claw.

3. The improvement as in claim 1 wherein each of said electrode pins is at least hollow in parts and connected to a coolant flow.

4. The improvement as in claim 1 wherein said current feeding structure is annularly arranged around of the axis of said vessel.

5. The improvement as in claim 3 wherein said coolant flow is provided by a gas circulation of an inert gas.

6. The improvement as in claim 4 includes a pressure gauge connected to said coolant flow at said pin.

7. The improvement as in claim 1, said connecting means includes a contact clamp and a metallic tension ribbon connecting said pin to said current feeding structure.

8. The improvement as in claim 7, said current feeding structure is connected to said vessel bottom through an insulating clamp.

* * * * *